US008992284B2

(12) United States Patent
Weidetz et al.

(10) Patent No.: US 8,992,284 B2
(45) Date of Patent: Mar. 31, 2015

(54) RECONFIGURABLE TOY ASSEMBLY

(75) Inventors: Erich W. Weidetz, Santa Monica, CA (US); Ethan Wood, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 337 days.

(21) Appl. No.: 13/422,304

(22) Filed: Mar. 16, 2012

(65) Prior Publication Data

US 2012/0238181 A1 Sep. 20, 2012

Related U.S. Application Data

(60) Provisional application No. 61/453,361, filed on Mar. 16, 2011.

(51) Int. Cl.
*A63H 13/16* (2006.01)
*A63H 33/00* (2006.01)

(52) U.S. Cl.
CPC ..... *A63H 33/003* (2013.01)
USPC ..... 446/310

(58) Field of Classification Search
USPC ..... 446/71–73, 76, 310, 429, 435, 473, 446/475; 42/51, 52, 54
See application file for complete search history.

(56) References Cited

U.S. PATENT DOCUMENTS

| | | | | |
|---|---|---|---|---|
| 784,888 | A | | 3/1905 | Reisner |
| 1,690,778 | A | | 11/1928 | Ford |
| 2,288,798 | A | | 7/1942 | Fleming |
| 2,424,538 | A | | 7/1947 | Beder |
| 2,619,769 | A | | 12/1952 | Gallaher |
| 2,651,881 | A | | 9/1953 | Glass et al. |
| 2,839,869 | A | | 6/1958 | Lopez |
| 2,858,644 | A | * | 11/1958 | Derham ..... 446/310 |
| 2,974,954 | A | * | 3/1961 | Martin ..... 472/54 |
| 3,201,896 | A | | 8/1965 | Dalhart |
| 3,456,320 | A | * | 7/1969 | Johnson ..... 29/890.03 |
| 3,546,789 | A | | 12/1970 | Kushell et al. |
| 3,572,715 | A | * | 3/1971 | Ramirez ..... 473/569 |
| 3,586,320 | A | * | 6/1971 | Mace ..... 472/54 |
| D226,101 | S | | 1/1973 | Marcus |
| 3,768,175 | A | * | 10/1973 | Hill et al. ..... 434/348 |
| 3,876,205 | A | | 4/1975 | Drohomirecky |
| 4,192,093 | A | | 3/1980 | Hamano |
| 4,197,670 | A | | 4/1980 | Cox |

(Continued)

FOREIGN PATENT DOCUMENTS

| | | | |
|---|---|---|---|
| GB | 2160113 | A | 12/1985 |
| JP | 3-182288 | A | 8/1991 |

*Primary Examiner* — Kurt Fernstrom
(74) *Attorney, Agent, or Firm* — Edell, Shapiro & Finnan LLC

(57) ABSTRACT

A reconfigurable toy assembly includes an external component having a first portion releaseably coupled to a second portion, the first and second portions forming a cavity when coupled together, and an internal component. A trigger is coupled to the external component. The internal component is reconfigurable between a retracted configuration and a deployed configuration. The internal component is retained in the retracted configuration via a latch and released from the retracted configuration upon actuation of the latch. The internal component is receivable in the cavity in its retracted configuration. The latch is actuatable by activating the trigger, so that the internal component is primed to reconfigure from the retracted configuration to the deployed position upon decoupling of the first and second portions.

13 Claims, 16 Drawing Sheets

(56) References Cited

U.S. PATENT DOCUMENTS

| | | | | | |
|---|---|---|---|---|---|
| 4,237,649 | A | | 12/1980 | Goldfarb et al. | |
| 4,356,662 | A | | 11/1982 | Strasser et al. | |
| 4,407,504 | A | * | 10/1983 | Popov | 273/153 R |
| 4,453,340 | A | * | 6/1984 | Kozuka et al. | 446/437 |
| 4,464,860 | A | | 8/1984 | Onodera | |
| 4,504,239 | A | | 3/1985 | Kulesza et al. | |
| 4,595,378 | A | | 6/1986 | Sweet et al. | |
| 4,654,018 | A | * | 3/1987 | Farrington et al. | 446/38 |
| 4,736,943 | A | | 4/1988 | Fukuda et al. | |
| 4,737,135 | A | | 4/1988 | Johnson et al. | |
| 4,817,936 | A | | 4/1989 | Matsuda | |
| 4,836,821 | A | | 6/1989 | Raymond | |
| 5,090,935 | A | | 2/1992 | Monson | |
| 5,120,263 | A | * | 6/1992 | Ierfino et al. | 446/486 |
| 5,224,894 | A | * | 7/1993 | Nelson et al. | 446/73 |
| 5,308,277 | A | | 5/1994 | Nielsen | |
| 5,597,339 | A | | 1/1997 | Spector | |
| 5,816,888 | A | | 10/1998 | Myers | |
| 5,941,753 | A | | 8/1999 | Diresta | |
| 5,954,563 | A | * | 9/1999 | Spriggs | 446/475 |
| 6,106,361 | A | | 8/2000 | Petris | |
| 6,468,126 | B1 | * | 10/2002 | Herber | 446/310 |
| 6,592,426 | B2 | * | 7/2003 | Mesch | 446/310 |
| 6,702,644 | B1 | | 3/2004 | Hornsby et al. | |
| D489,100 | S | | 4/2004 | Pino | |
| 6,752,679 | B1 | | 6/2004 | Lui | |
| 6,761,612 | B1 | * | 7/2004 | Pencil et al. | 446/310 |
| 7,008,289 | B2 | * | 3/2006 | Norman | 446/310 |
| 7,121,917 | B2 | | 10/2006 | Hardouin et al. | |
| D533,909 | S | | 12/2006 | Whitten | |
| 7,189,134 | B2 | | 3/2007 | Nugent et al. | |
| 2004/0142628 | A1 | | 7/2004 | Pino | |
| 2004/0259646 | A1 | | 12/2004 | Clark et al. | |
| 2010/0144234 | A1 | | 6/2010 | Wai et al. | |

* cited by examiner

P1
156
152
154
132
146
138
134
130
136
140
148
132

A10
156
P2
130

132
136
132
146
138
134
130
140
148
124
C4

124
A11
146
A12
148
130

124
A13
A14
130

C3
124
A15
A16
130

RECONFIGURABLE TOY ASSEMBLY

CROSS-REFERENCE TO RELATED APPLICATION

This application claims priority to and is based on U.S. Patent Application No. 61/453,361, filed Mar. 16, 2011, entitled "Reconfigurable Toy Assembly," the entire disclosure of which is incorporated by reference herein in its entirety.

FIELD OF THE INVENTION

The present invention relates to a toy assembly, and in particular, to a toy assembly including an outer shell defining a receiving area and a reconfigurable internal component placeable within the receiving area.

BACKGROUND OF THE INVENTION

Various toy assemblies having nesting figures are known. Such toy assemblies typically include a series of nestable figures separable into at least two parts. Other toy assemblies include vehicles which include an outer vehicle body that encases but is removable from an inner vehicle body.

There is a need for a unique toy assembly including an outer component and an inner component, with the inner component being reconfigurable. Further, there is a need for a toy assembly including an outer component and an inner component, with the inner component being configured to launch projectiles.

SUMMARY OF THE INVENTION

The present invention is directed to a reconfigurable toy assembly. The assembly includes an external component including a first portion releaseably coupled to a second portion. The first and second portions form a cavity when coupled together. A trigger is coupled to the external component. The assembly also includes an internal component reconfigurable between a retracted configuration and a deployed configuration. The internal component is retained in the retracted configuration via a latch and released from the retracted configuration upon actuation of the latch. The internal component is receivable in the cavity in its retracted configuration. The latch is actuatable by activating the trigger so that the internal component is primed to reconfigure from the retracted configuration to the deployed configuration upon decoupling of the first portion and the second portion.

In one embodiment, the assembly further includes at least one projectile coupled to the internal component. The projectile automatically launches from the internal component when the internal component moves from the retracted configuration to the deployed configuration. In one implementation, the at least one projectile is retained within the cavity when coupled to the internal component.

In one embodiment, the internal component includes a body portion defining a cavity, and an extension member coupled to the body portion. The extension member is movable between an open position permitting access to the cavity and a closed position restricting access to the cavity. In one implementation, the extension member is disposed in the open position when the internal component is in the deployed position, and the extension member is disposed in the closed position when the internal component is in the retracted position. In one implementation, a secondary internal component is releaseably disposable within the cavity.

In one embodiment, the external component includes a lock mechanism configured to releaseably secure the first portion to the second portion. The lock mechanism includes a release actuatable by a user for decoupling the first portion to the second portion. In one implementation, the first portion is tensionably coupled to the second portion, so that the first portion is forcibly ejected away from the second portion upon actuation of the release.

The present invention is also directed to a toy figure including an outer shell, a lock mechanism, and an internal component. The outer shell includes a first portion releaseably coupled to a second portion. The first and second portions form a receiving area when coupled together. The lock mechanism is coupled to the outer shell and configured to releaseably secure the first portion to the second portion. The lock mechanism includes a release actuatable by a user for decoupling the first portion to the second portion. The first portion is tensionably coupled to the second portion so that the first portion is forcibly ejected away from the second portion upon actuation of the release. The internal component is retainable within the receiving area.

In one embodiment, the internal component is reconfigurable between a retracted configuration and a deployed configuration. The internal component is retained in the retracted configuration via a latch and released from the retracted configuration upon actuation of the latch. The internal component is retained within the receiving area in its retracted configuration.

In one embodiment, a trigger is coupled to the outer shell. The latch of the internal component is actuatable by activating the trigger so that the internal component is primed to reconfigure from the retracted configuration to the deployed position upon decoupling the first portion from the second portion.

In one embodiment, at least one projectile is coupled to the internal component. The projectile is automatically launched from the internal component when the internal component moves from the retracted configuration to the deployed configuration. In one implementation, the internal component defines a receptacle. The at least one projectile is retainable within the receptacle when the internal component is disposed in the retracted configuration.

BRIEF DESCRIPTION OF THE DRAWINGS

Like reference numerals have been used to identify like elements throughout this disclosure.

DETAILED DESCRIPTION OF THE INVENTION

Figure 1:
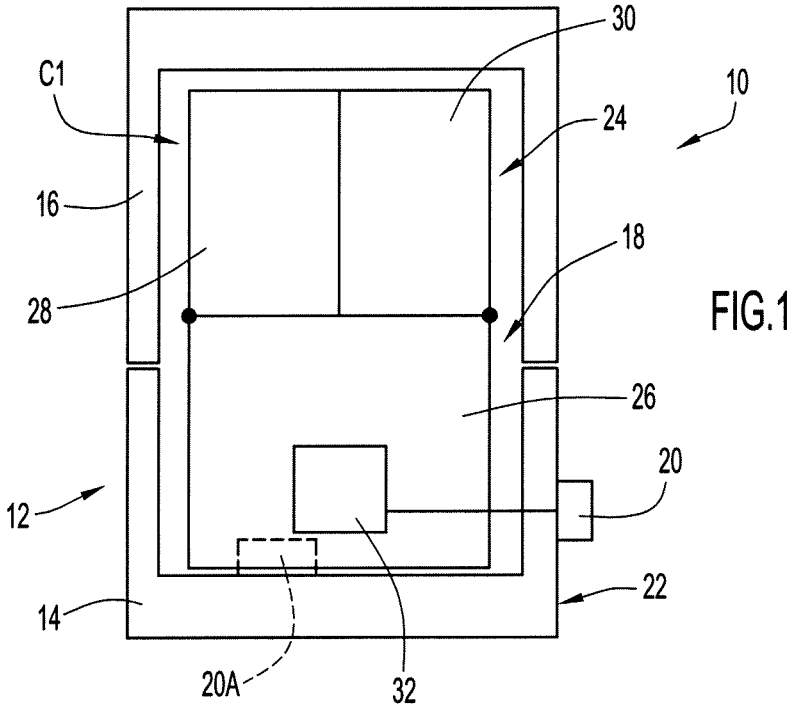
FIG. 1 illustrates a schematic diagram of a reconfigurable toy assembly according to an embodiment of the present invention, showing an internal component in a retracted configuration.
Figure 2:
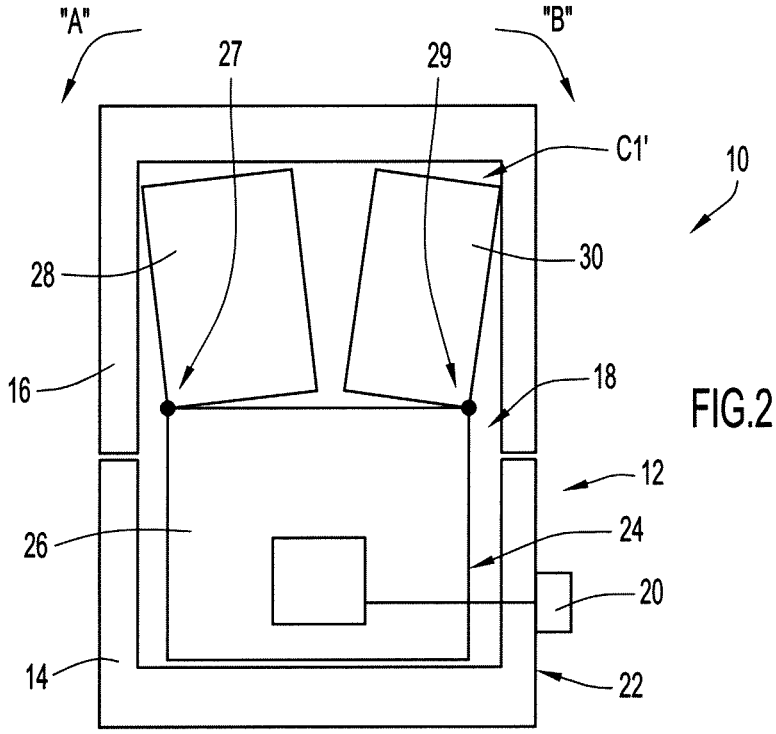
FIG. 2 illustrates a schematic diagram of the reconfigurable toy assembly of FIG. 1, showing the internal component in a substantially configuration.
Figure 3:
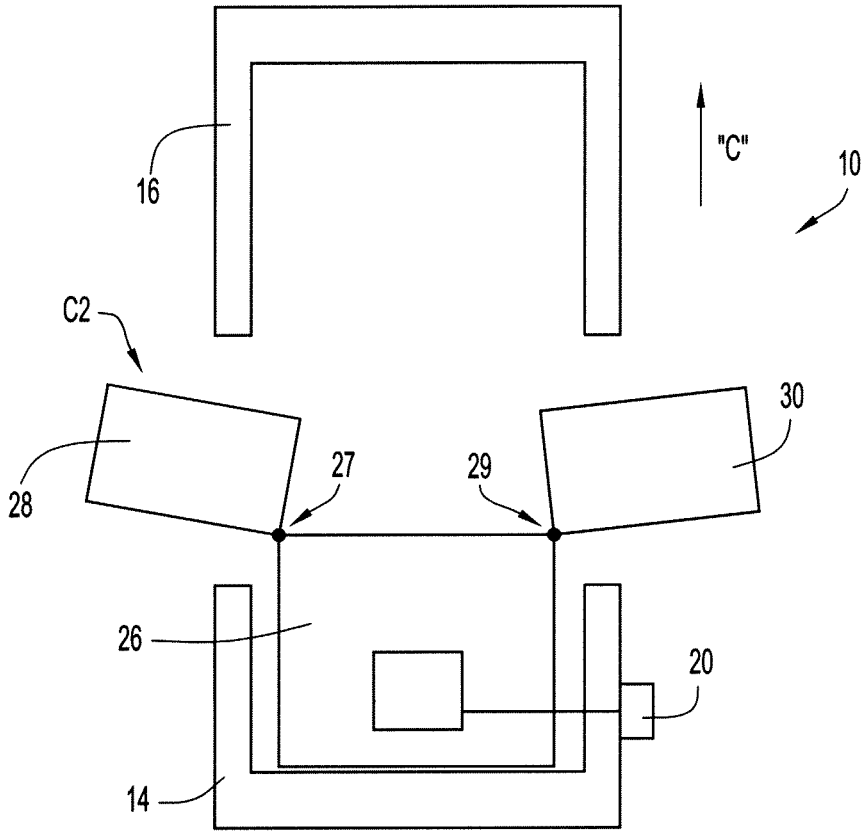
FIG. 3 illustrates a schematic diagram of the reconfigurable toy assembly of FIG. 1, showing an upper portion of an external component decoupled from a lower portion thereof and the internal component in a deployed configuration.

FIGS. 1, 2 and 3 illustrate schematic diagrams of a reconfigurable toy assembly 10 according to an embodiment of the present invention. The assembly 10 includes an external component or body 12 having a first or lower portion 14 releaseably coupled to a second or upper portion 16. The lower and upper portions 14, 16 form a cavity 18 when coupled together, as shown in FIGS. 1 and 2. A trigger 20 is coupled to exterior surface 22 of the lower portion 14 of the external component 12, which is in communication with the cavity 18. The trigger 20 is accessible by a user on the outside of the external component 12, such as on exterior surface 22.

An internal component or body 24 is receivable in the cavity 18. The internal component 24 includes a body portion 26 and segments 28, 30 movable relative to the body portion 26. In this embodiment, the movable segments 28, 30 are outwardly pivotable, so that the internal component 24 is reconfigurable between a retracted configuration C1 (shown in FIG. 1) and a deployed configuration C2 (shown in FIG. 3). The internal component 24 is retained in its retracted configuration C1 via a latch 32. Upon actuation of the latch 32, the internal component 24 reconfigures or moves from its retracted configuration C1 to its deployed configuration C2.

As shown in FIG. 1, the internal component 24 is receivable in the cavity 18 in its retracted configuration C1. When the internal component 24 is disposed within the cavity 18, the trigger 20 is in communication with the latch 32. Activation of the trigger 20 by a user actuates the latch 32 of the internal component 24 when the internal component 24 is disposed within the cavity 18, so that the internal component 24 is primed for reconfiguration from a substantially retracted configuration C1' (shown in FIG. 2) to the fully deployed configuration C2 (shown in FIG. 3) upon decoupling of the upper portion 16 from the lower portion 14.

In another embodiment, the trigger 20A may be located in the cavity 18 or interior of the lower portion 14 instead of on the exterior. For example, the insertion of internal component 24 into the cavity 18 may result in the activation of the trigger 20A (shown in phantom in FIG. 1) located on the inner surface 15 of the lower portion 14. In one implementation, the trigger 20A is a projection or boss that engages the latch 32 of the internal component 24 when the upper portion 16 and lower portion 14 are coupled together. As a result, no external activation is required to prime the internal component 24 for reconfiguration.

Referring to FIGS. 2 and 3, the movable segments 28, 30 are coupled to body portion 26 via joints or hinges 27, 29, respectively, and movable along the directions of arrows "A" and "B." When the upper portion 16 is moved along the direction of arrow "C" (see FIG. 3), the movable segments 26, 28 are permitted to move away from each other to expand the configuration of the internal component 24.

Referring to FIGS. 4, 5, 6 and 7, a toy figure 100 according to another embodiment is illustrated. The toy figure 100 includes an outer shell 102 including a lower portion 104 releaseably coupled to an upper portion 106 (see FIG. 5). The lower portion 104 and the upper portion 106 form a receiving area 108 (shown in FIG. 7) when coupled together. In one implementation, the lower portion 104 defines a lower cavity 110 (shown in FIG. 6) and the upper portion 106 defines an upper cavity 112 that is formed at least in part by an inner surface 164. In one embodiment, the upper portion 106 includes one or more simulated weapons 150.

Figure 4:
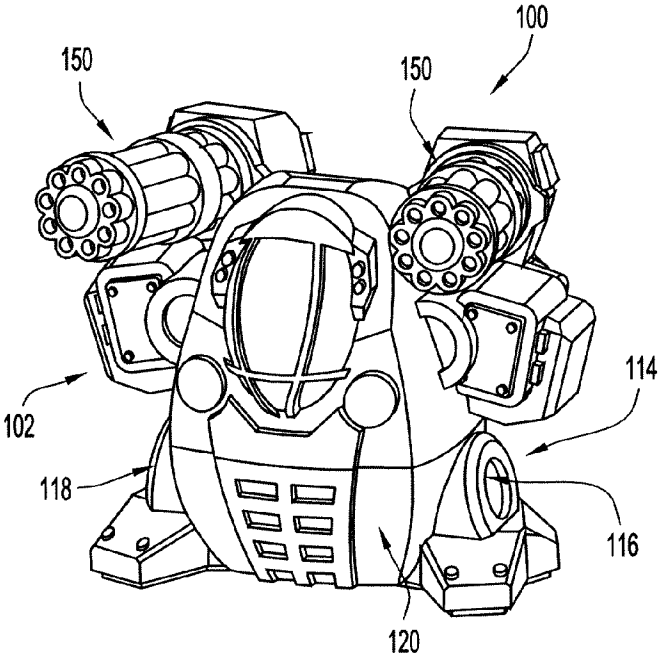
FIG. 4 illustrates a front perspective view of a reconfigurable toy figure according to another embodiment of the present invention.
Figure 7:
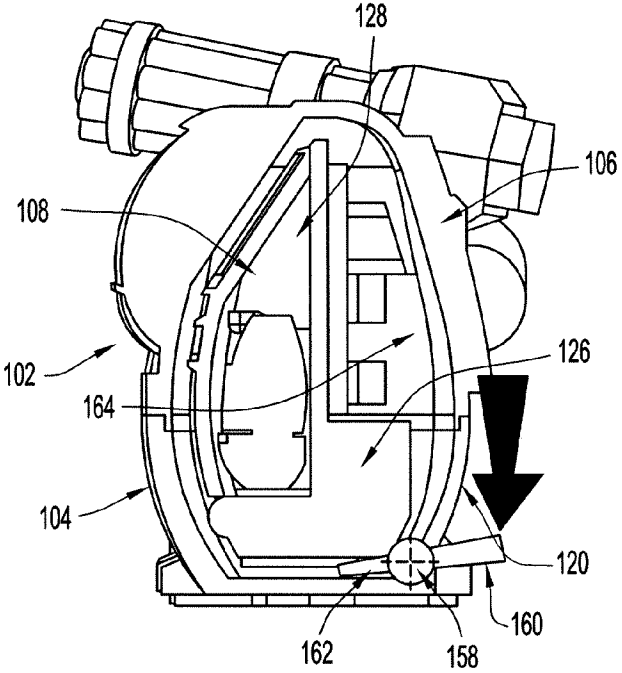
FIG. 7 illustrates a side sectional view of the toy figure of FIG. 4.

Referring back to FIG. 4, a lock mechanism 114 is coupled to the lower portion 104 of the outer shell 102. The lock mechanism 114 is configured to releaseably secure the upper portion 106 to the lower portion 104 (as shown in FIGS. 4 and 7). The lock mechanism 114 includes actuators, such as push buttons 116, 118 on opposite sides located along an exterior surface 120 of the lower portion 104 and that are inwardly depressible or actuatable (shown by arrows A1, A2 in FIG. 5) by a user for releasing the upper portion 106 from the lower portion 104 (as shown by arrow A3). In one implementation, the push buttons 116, 118 are operably coupled to latches (not shown) disposed on an inner surface 122 of the lower portion 104 (see FIG. 6). The latches engage correspondingly configured surfaces (e.g., such as recesses) provided on the upper portion 106. Upon depression of the push buttons 116, 118, the latches are released from the upper portion 106, so that the upper portion 106 may be decoupled from lower portion 104.

In one implementation, the upper portion 106 is tensionably coupled to the lower portion 104 via a resilient member (e.g., such as one or more springs). Upon depression of the push buttons 116, 118, the upper portion 106 is forcibly ejected away from the lower portion 104 (as shown by arrow A3 in FIG. 5) via the resilient member(s). In another implementation, the upper portion 106 is coupled to and retained against the lower portion 104 via a friction fit and/or detents. Upon depression of the push buttons 116, 118 and/or by inwardly squeezing the lower portion 104, the lower portion 104 is deformed so that the upper portion 106 disengages or "pops off" of the lower portion 104. In an alternative embodiment, a pinch point launching mechanism can be used instead of a spring-loaded launching mechanism.

Figure 5:
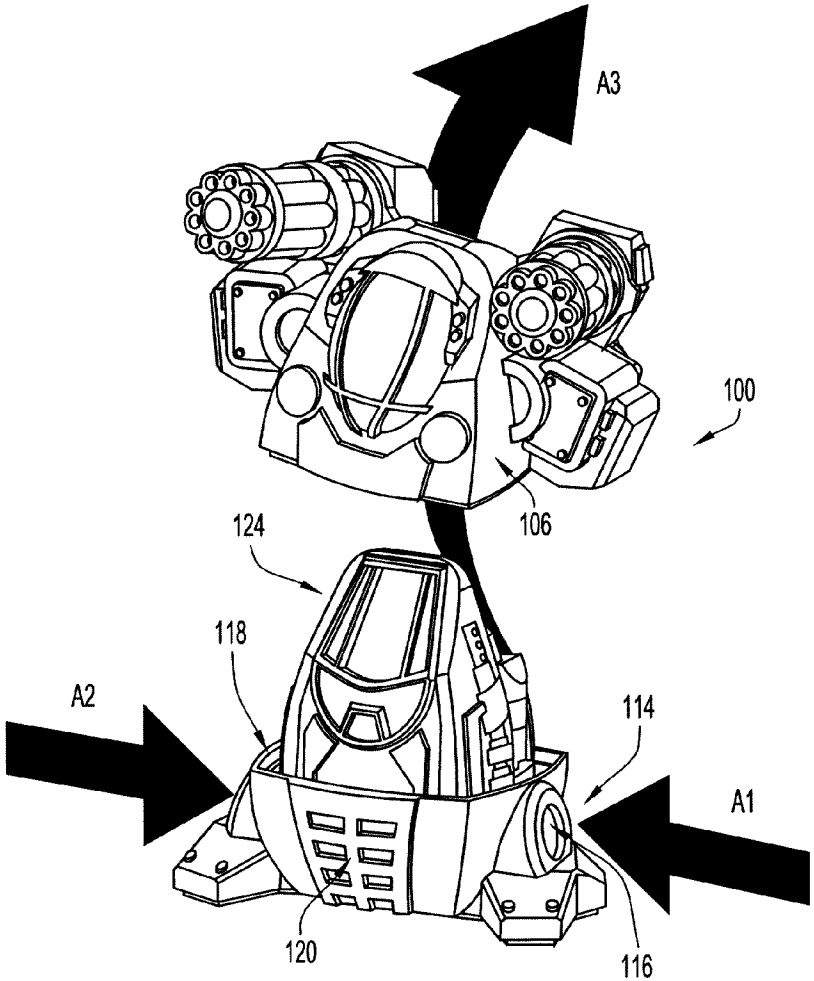
FIG. 5 illustrates another perspective view of the toy figure of FIG. 4, showing an upper portion of an outer shell decoupled from a lower portion thereof.
Figure 6:
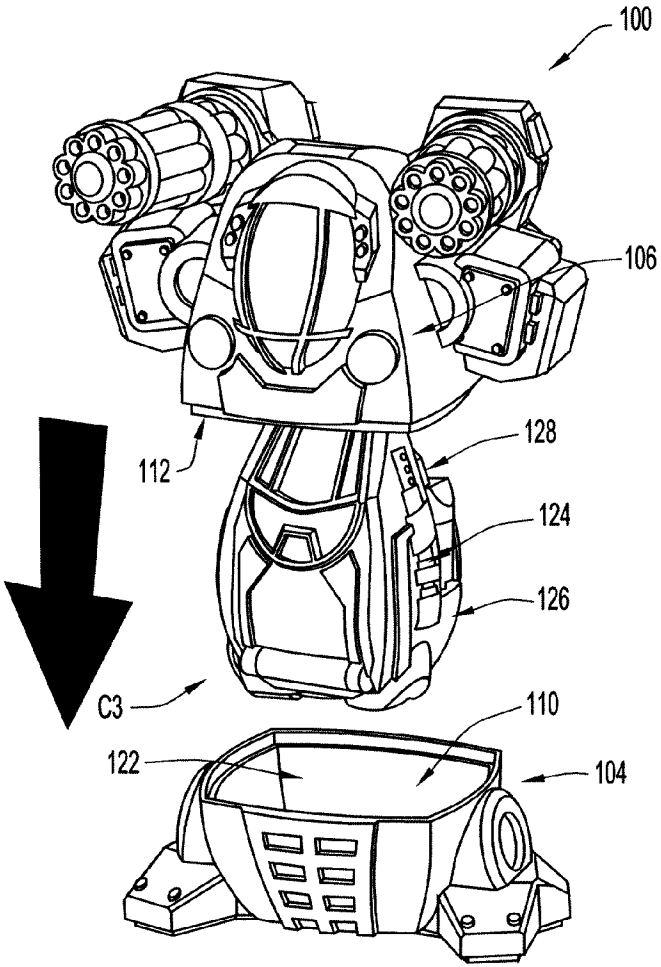
FIG. 6 illustrates another perspective view of the toy figure of FIG. 4, showing the upper and lower portions of the outer shell decoupled and an internal component removed from a lower cavity of the lower portion.

As shown in FIGS. 5, 6 and 7, an internal component 124 is placeable and retainable within the receiving area 108 of the outer shell 102. When the lower portion 104 of the outer shell 102 is decoupled from the upper portion 106, a portion 126 of the internal component 124 is receivable in the lower cavity 110 (see FIG. 7) of the lower portion 104. The remaining portion 128 of the internal component 124 is receivable in the upper cavity 112 of the upper portion 106 when the upper portion 106 is attached to the lower portion 104 of the outer shell 102 (as shown in FIG. 7). Thus, the internal component 124 is retained within the receiving area 108 when the upper portion 106 is coupled to the lower portion 104, and removable from or insertable into the lower cavity 110 of the lower portion 104 (or the upper cavity 112 of the upper portion 106) when the upper portion 106 is decoupled from the lower portion 104.

Figures 8A, 8B, 8C, 8D:
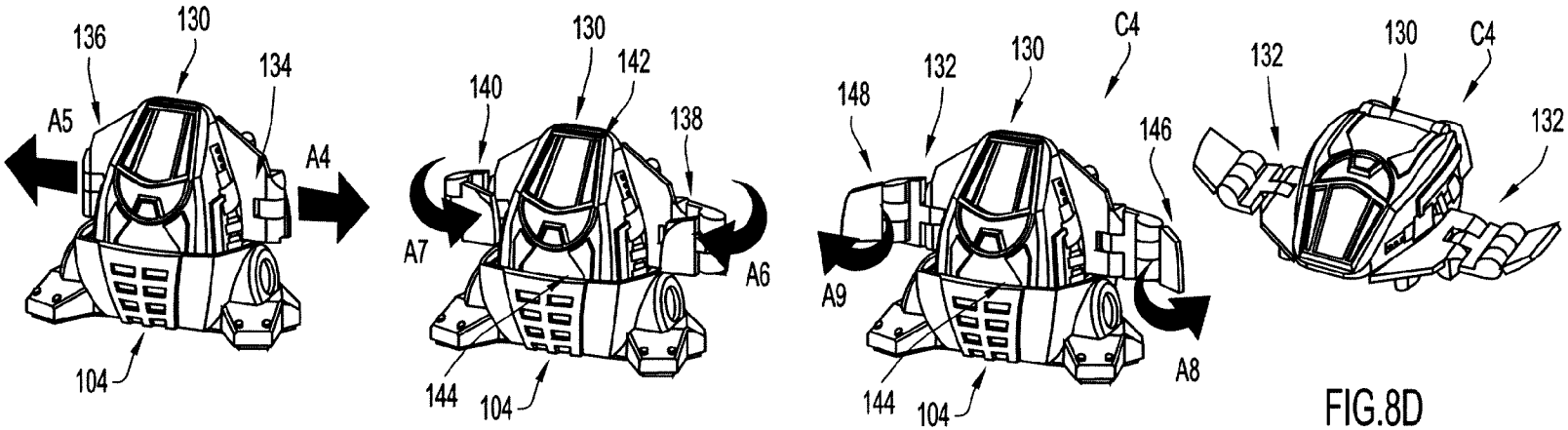
FIG. 8A illustrates a front perspective view of the internal component of the toy figure of FIG. 4 disposed in the lower portion of the outer shell, showing the internal component in a partially retracted configuration.
FIG. 8B illustrates another front perspective view of the internal component of the toy figure of FIG. 4 disposed in the lower portion of the outer shell, showing the internal component in another partially retracted configuration.
FIG. 8C illustrates another front perspective view of the internal component of the toy figure of FIG. 4 disposed in the lower portion of the outer shell, showing the internal component in a deployed configuration.
FIG. 8D illustrates a front perspective view of the internal component of the toy figure of FIG. 4 in the deployed configuration and removed from the lower portion of the outer shell.

Referring to FIGS. 6 and 8A-8D, in one embodiment, the internal component 124 is reconfigurable between a retracted configuration C3 (shown in FIG. 6) and a deployed configuration C4 (shown in FIGS. 8C and 8D). The internal component 124 includes a main body 130 and a plurality of segments 132 (shown in FIGS. 8C and 8D) movably connected to the main body 130. The segments 132 are tensionably biased outwardly and away from the main body 130 via one or more resilient members (e.g., springs). The internal component 124 is retained in its retracted configuration C3 with the tensionably biased segments 132 maintained proximate to or disposed within the main body 130 of the internal component 124 via one or more latches (not shown). Upon actuation of the latch or latches, the segments 132 are permitted to move outwardly and away from the main body 130, so that the internal component 124 is reconfigured from its retracted configuration C3 to its deployed configuration C4.

Referring again to FIGS. 5, 6 and 7, the internal component 124 is retained within the receiving area 108 in its fully retracted configuration C3. When the upper portion 106 of the outer shell 102 is decoupled from the lower portion 104 (as shown in FIG. 5), and the latch of the internal component 124 has been actuated, the internal component 124 automatically reconfigures from its retracted configuration C3 to its deployed configuration C4.

As shown in FIG. 8A, in one embodiment, the movable segments 132 include left and right inner plates 134, 136, which slide outwardly and in opposite directions away from the main body 130 as shown by arrows A4, A5. As shown in FIG. 8B, middle plates 138, 140 then pivot outwardly from a position proximate to a rear face 142 of the internal component 124 in a direction toward a front face 144 of the internal component 124, as shown by arrows A6, A7, respectively. As shown in FIG. 8C, outer plates 146, 148 then pivot outwardly in a direction toward the rear face 142 of the internal component 124, as shown by arrows A8, A9, respectively. The internal component 124 may be removed from the lower cavity 110 of the lower portion 104 for additional and/or alternative play patterns, as shown in FIG. 8D.

In one implementation, the internal component 124 is configured to resemble a futuristic air or space craft, with the movable segments 132 configured to resemble wings in the deployed configuration C4. In other embodiments, the internal component 124 may have a different configuration and/or resemble a vehicle, character, animal, etc. having an alternative theme. Further, the outer shell 102 may have a configuration corresponding to the theme of the internal component 124 (e.g., such as a space craft or futuristic figure as illustrated). The outer shell 102 may also include portions configured to resemble projectile launchers 150, as shown in FIGS. 4-7. Alternatively or in addition, the outer shell 102 may include functioning projectile launchers, which eject one or more projectiles or missiles.

Figures 9A, 9B, 10A, 10B, 10C, 10D:
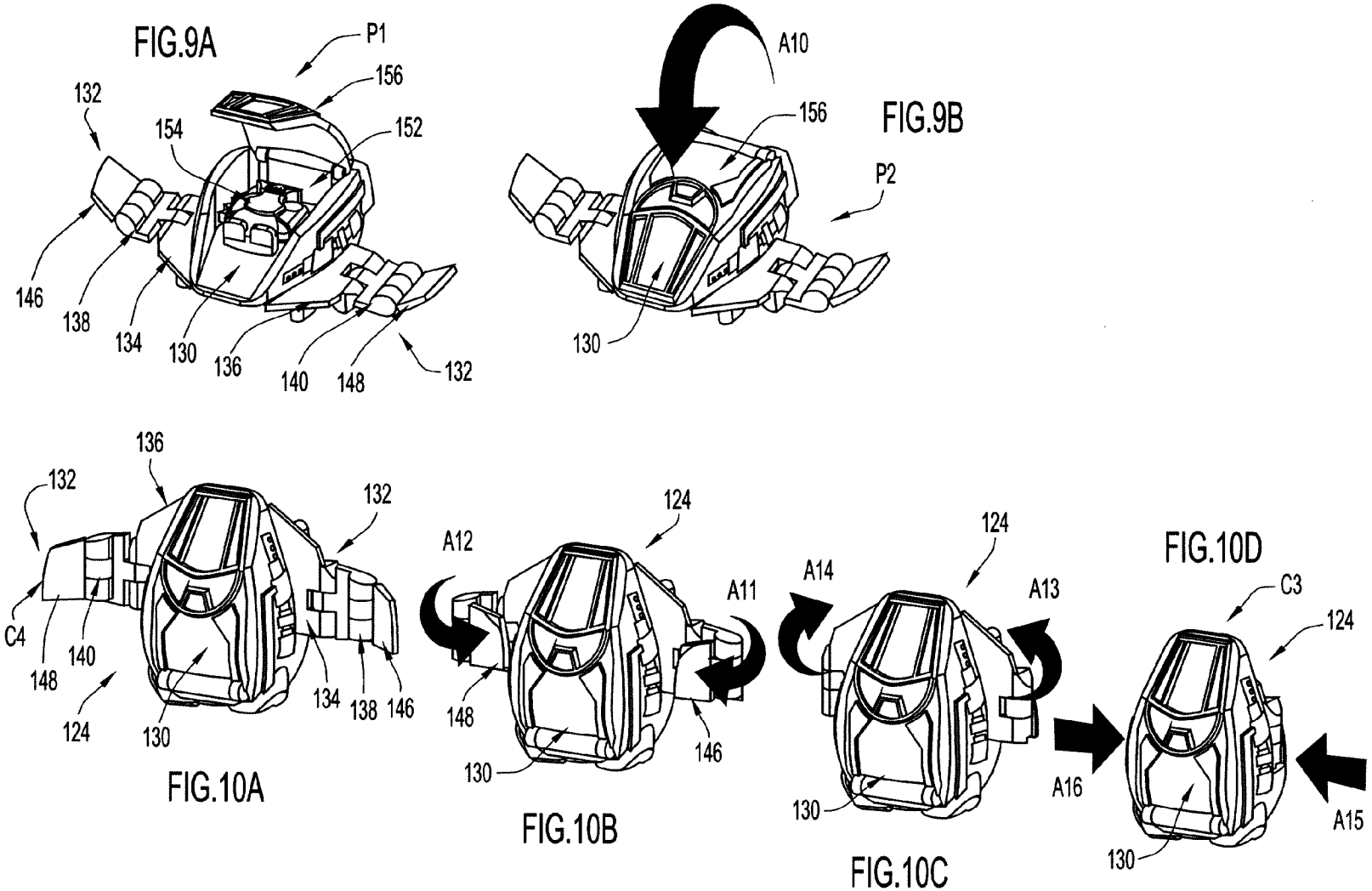
FIG. 9A illustrates a perspective view of the internal component of the toy figure of FIG. 4, showing an extension member in an open position.
FIG. 9B illustrates another perspective view of the internal component of the toy figure of FIG. 4, showing the extension member in a closed position.
FIG. 10A illustrates another perspective view of the internal component of the toy figure of FIG. 4 in a deployed configuration.
FIG. 10B illustrates another perspective view of the internal component of the toy figure of FIG. 4 in a partially retracted configuration.
FIG. 10C illustrates another perspective view of the internal component of the toy figure of FIG. 4 in another partially retracted configuration.
FIG. 10D illustrates another perspective view of the internal component of the toy figure of FIG. 4 in a retracted configuration.

Referring to FIGS. 9A and 9B, the various components of the movable segments 132 are illustrated. As shown, one portion or wing includes an inner plate 134, a middle plate 138, and an outer plate 146. Similarly, the other wing-like structure includes an inner plate 136, a middle plate 140, and an outer plate 148.

In addition, in one embodiment, the main body 130 of the internal component 124 defines a recess or cavity 152 configured to releaseably retain a secondary internal component 154. An extension member 156, such as a cover or lid, is coupled to the main body 130 and movable between an open position P1 (shown in FIG. 9A) permitting access to the cavity 152 and a closed position P2 (shown in FIG. 9B) restricting access to the cavity 152. In one implementation, the extension member 156 is pivotally movable about an axis substantially perpendicular to the longitudinal axis of the main body 130, and along the direction of arrow A10. The secondary internal component 154 may be inserted into or removed from the cavity 152 when the extension member 156 is disposed in its open position P1, and the secondary internal component 154 may be retained within the cavity 152 when the extension member 156 is moved to and disposed in its closed position P2.

In one implementation, the secondary internal component 154 is configured to resemble a humanoid-like or robotic character. For example, the secondary internal component 154 may represent the pilot of the toy vehicle (i.e. the internal component 124 and/or the outer shell 102). In other embodiments, the secondary internal component 154 has an alternative configuration.

The extension member 156 is permitted to move from its closed position P2 to its open position P1 when the internal component 124 is removed from the receiving area 108 of the outer shell 102. In one implementation, the extension member 156 is disposed in its closed position P2 and restricted from moving to its open position P1 when the internal component 124 is disposed in the lower cavity 110 of the lower portion 104 and/or the receiving area 108 of the outer shell 102 (as shown in FIGS. 5 and 7).

Referring to FIGS. 10A-10D, the internal component 124 may be reconfigured from its deployed configuration C4 (shown in FIG. 10A) to its fully retracted configuration C3 (shown in FIG. 10D) by moving the segments 132 inwardly and toward the main body 130 (e.g., in a movement cycle opposite to the cycle of movement illustrated in FIGS. 8A-8D and described above). Thus, as shown in FIG. 10B, the outer plates 146, 148 are pivoted inwardly in a direction toward the front face 144 of the internal component 124, as shown by arrows A11, A12. As shown in FIG. 10C, the outer plates 146, 148 and the middle or central plates 138, 140 are then together pivoted in a direction toward the rear face 142 of the internal component 124, as shown by arrows A13, A14. As shown in FIG. 10D, the left and right inner plates 134, 136 are then slid inwardly and in a direction toward the main body 130 (or into a correspondingly configured recess in the main body 130), as shown by arrows A15, A16. The movable segments 132 are retained in their inwardly disposed and compressed positions via the latch, so that the internal component 124 is retained in its retracted configuration C3 until actuation of the latch.

Referring again to FIG. 7, an actuator or trigger 158 is coupled to the lower portion 104 of the outer shell 102. In this embodiment, the actuator 158 resembles a lever. The trigger 158 includes an outer member 160 extending outwardly from or disposed on the exterior surface 120 of the lower portion 104, and an inner member 162 disposed within the lower cavity 110 of the lower portion 104. The outer member 160 is configured to be engaged and activated by a user, such as by depressing or pivotally moving the outer member 160 relative to the lower portion 104. When the internal component 124 is disposed within the lower cavity 110 of the lower portion 104, the inner member 162 of the trigger 158 is aligned with and engageable with the latch of the internal component 124.

Upon actuation of the outer member 160 (e.g., such as when a user depresses or otherwise moves the outer member 160), the inner member 162 is caused to engage and actuate the latch. The movable segments 132 are thus released from their latched positions adjacent to the main body 130 of the internal component 124, and are permitted to move outwardly until they engage an inner surface 164 defining the upper cavity 112 of the upper portion 106 of the outer shell 102. The movable segments 132 are restricted from moving outwardly to their fully expanded positions due to the restricted space of the receiving area 108. However, the movable segments 132 automatically move outwardly to their fully extended positions when the upper portion 106 is decoupled from the lower portion 104 of the outer shell 102. Thus, the internal component 124 may be primed for reconfiguration from its retracted configuration C3 to its deployed position C4 by actuating the trigger 158 on the outer shell 102. The internal component 124 then automatically reconfigures to its deployed position C4 upon decoupling of the upper portion 106 from the lower portion 104 (such as shown in FIG. 5).

In an alternative embodiment, the latch of the internal component 124 can be activated simply by putting the internal component 124 inside the outer shell 102. The internal component 124 may engage a boss inside the outer shell 102 so that the boss engages and activates the latch when the upper portion 106 and the lower portion 104 are fit together.

Figures 11A, 11B, 11C:
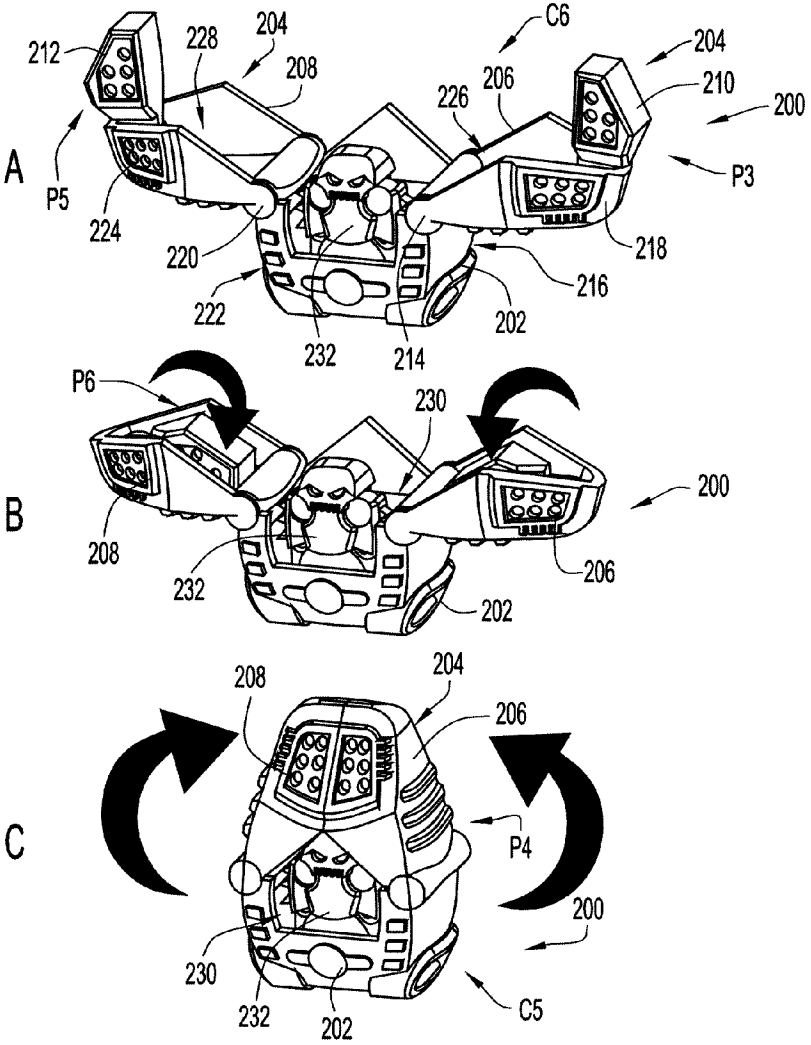
FIG. 11A illustrates a perspective view of an internal component according to another embodiment, showing the internal component in a deployed configuration.
FIG. 11B illustrates a perspective view of the internal component of FIG. 11A, showing the internal component in a partially retracted configuration.
FIG. 11C illustrates a perspective view of the internal component of FIG. 11A, showing the internal component in a retracted configuration.

An internal component 200 according to another embodiment is illustrated in FIGS. 11A-11C. The internal component 200 is reconfigurable between a fully deployed configuration C6 (shown in FIG. 11A) and a retracted configuration C5 (shown in FIG. 11C). Similar to the internal component 124 described above, the internal component 200 includes a main body 202 and a plurality of segments 204 movably connected to the main body 202 and tensionably biased outwardly and away from the main body 202 via one or more resilient members (e.g., springs). The internal component 200 is retained in its retracted configuration C5 with the tensionably biased segments 204 folded inwardly and proximate to the main body 202 via a latch. Upon actuation of the latch, the segments 204 are permitted to move outwardly and away from the main body 202, so that the internal component 200 reconfigures from its retracted configuration C5 to its deployed configuration C6.

As shown in FIG. 11A, the movable segments 204 include arm members 206, 208 and extenders 210, 212. The arm members 206, 208 can be referred to alternatively as left and right arm members or first and second arm members. Similarly, the extenders 210, 212 can be referred to alternatively as left and right extenders or first and second extenders. A first arm member 206 includes an end 214 pivotally coupled to a first side 216 of the main body 202, and an opposite distal end 218. A second arm member 208 includes an end 220 pivotally coupled to a second side 222 of the main body 202, and an opposite distal end 224. A first extender 210 is pivotally coupled to the distal end 218 of the first arm member 206, and a second extender 212 is pivotally coupled to the distal end 224 of the second arm member 208.

The arm members 206, 208 are movable between positions P3 extending outwardly from the sides 216, 222 of the main body 202 (shown in FIG. 11A), and folded positions P4 extending upwardly from the main body 202 (shown in FIG. 11C). The extenders 210, 212 are movable between positions P5 extending upwardly from the distal ends 218, 224 of the arm members, 206, 208, respectively (shown in FIG. 11A), and positions P6 folded inwardly toward the ends 214, 220 of the arm members 206, 208 (shown in FIG. 11B). In one implementation, the arm members 206, 208 include recessed areas or channels 226, 228, respectively, which are configured for receiving the extenders 210, 212, respectively (shown in FIG. 11B).

In one embodiment, the arm members 206, 208 are biased toward their outwardly extending positions P3 via resilient members (e.g., springs). Similarly, the extenders 210, 212 are biased toward their upwardly extending positions P5 via additional resilient members (e.g., springs). The extenders 210, 212 may be moved to their folded positions P6 (as shown in FIG. 11B), and then the arm members 206, 208 pivoted upwardly to their folded positions P4 (as shown in FIG. 11C), and retained in the folded positions P4 via a latch. Upon actuation of the latch, the arm members 206, 208 are released from their folded positions P4, and automatically move downwardly and to their outwardly extending positions P3 via the associated resilient members. Further, the extenders 210, 212 automatically pivot to their upwardly extending positions P5 via their associated resilient members.

With continued reference to FIGS. 11A-11C, in one embodiment, the main body 202 of the internal component 200 defines a recess or cavity 230 configured to releaseably retain a secondary internal component 232 (similar to secondary internal component 154 previously described). The secondary internal component 232 may be inserted into or removed from the cavity 230 when the arm members 206, 208 are disposed in their outwardly extending positions P3 (shown in FIGS. 11A and 11B). The secondary internal component 232 may be retained within the cavity 230 when the arm members 206, 208 are disposed in their upwardly extending positions P4 (shown in FIG. 11C).

Figure 12B:
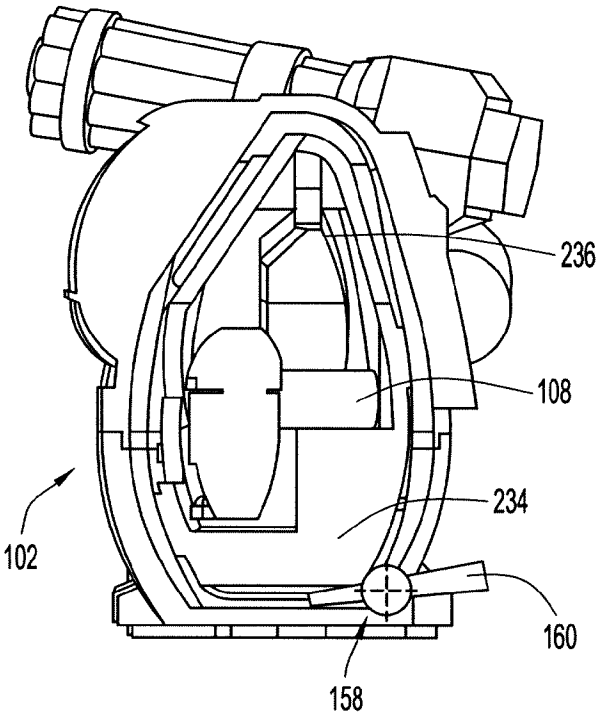
FIG. 12B illustrates a side sectional view of the outer shell and internal component of FIG. 12A.
Figure 12A:
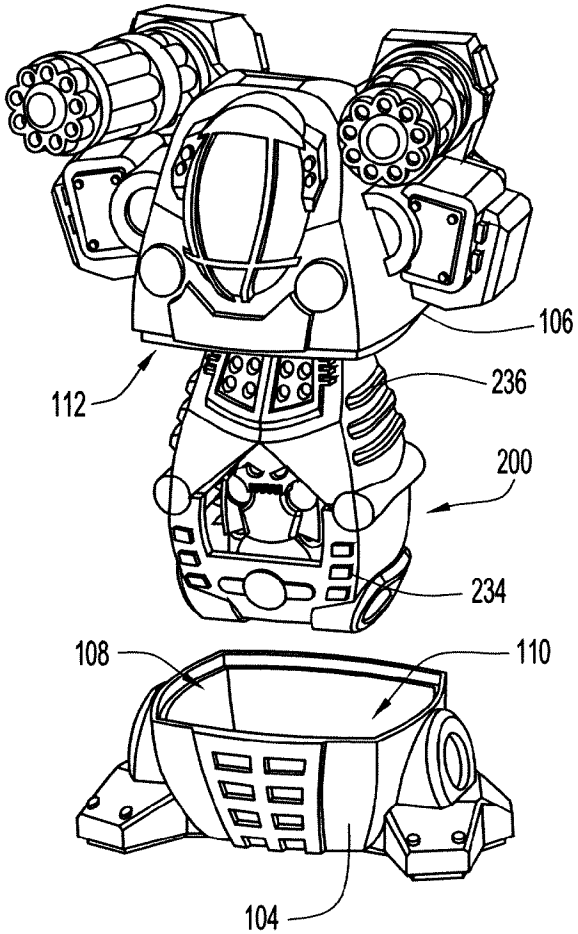
FIG. 12A illustrates a perspective view of the internal component of FIG. 11A being inserted into an outer shell.

Referring to FIGS. 12A and 12B, the internal component 200 is receivable in the receiving area 108 of the outer shell 102. Thus, a portion 234 of the internal component 200 is received in the lower cavity 110 of the lower portion 104, and another portion 236 of the internal component 200 is received in the upper cavity 112 of the upper portion 106. The internal component 200 is substantially or entirely hidden from view when disposed within the receiving area 108 of the outer shell 102 (as shown in FIG. 12B).

With continued reference to FIG. 12B, the latch of the internal component 200 may be actuated by depressing the outer member or portion 160 of the actuator or trigger 158 on the outer shell 102, as described above. Upon actuation of the trigger 158 and thus the aligned latch on the internal component 200, the left and right arm members 206, 208 are no longer retained in their upwardly extending positions P3 via the latch, but instead are retained in their substantially upward positions due to the space restrictions within the receiving area 108 of the outer shell 102. Thus, the internal component 200 is primed to reconfigure from its retracted position C5 to its deployed position C6.

Figure 13A:
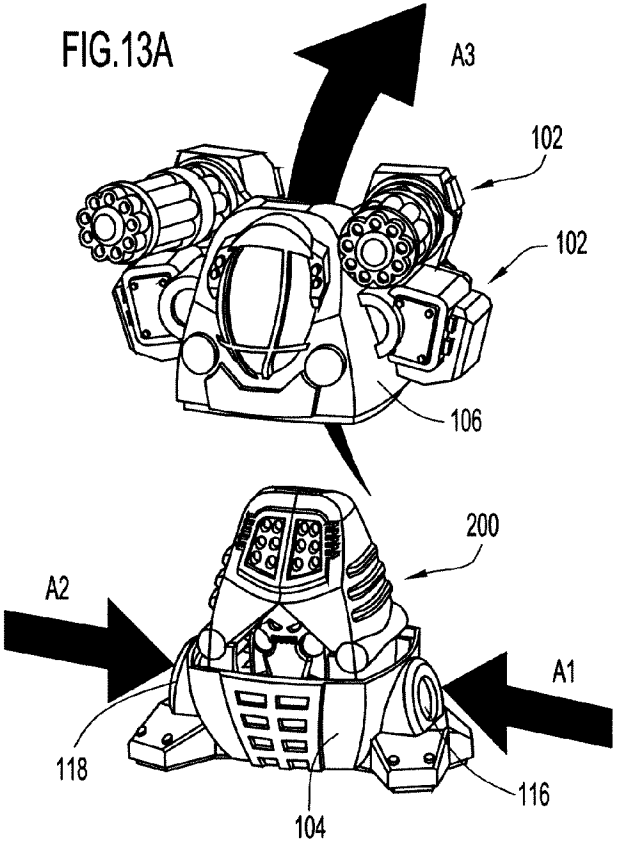
FIG. 13A illustrates a perspective view of the internal component of FIG. 11A disposed within the lower cavity of the lower portion of the outer shell, showing the upper portion of the outer shell being decoupled from the lower portion thereof.
Figure 13B:
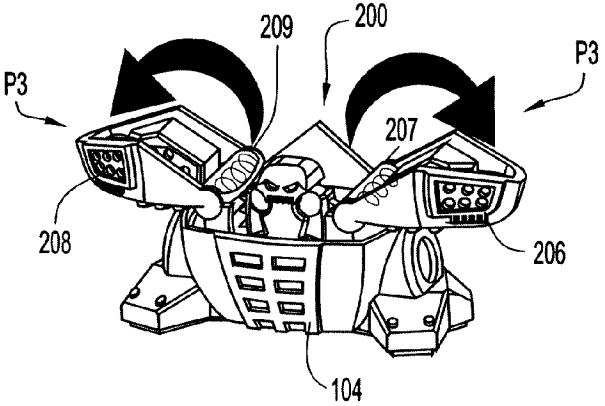
FIG. 13B illustrates a perspective view of the internal component and lower portion of the outer shell of FIG. 13A, showing segments of the internal component moved to a partially deployed configuration.
Figure 13C:
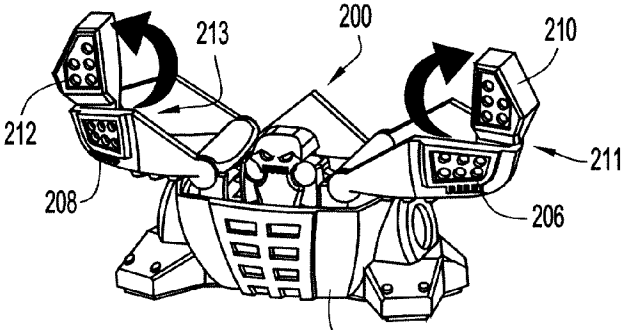
FIG. 13C illustrates another perspective view of the internal component and lower portion of the outer shell of FIG. 13A, showing segments of the internal component moved to the deployed configuration.

Referring to FIG. 13A, the upper portion 106 of the outer shell 102 may be ejected in a direction away from the lower portion 104 by activating the push buttons 116, 118, as shown by arrows A1, A2 and as described above. As a result, internal component 200 can transform. As shown in FIG. 13B, once the upper portion 106 is decoupled from the lower portion 104, further movement of the arm members 206, 208 is no longer restricted by the inner surface 164 of the upper cavity 112 of the upper portion 106. Thus, the arm members 206, 208 pivot downwardly to their outwardly extending positions P3 due to the biasing forces of their respective biasing or resilient members 207, 209, which are internal, but illustrated in FIG. 13B. Further, the extenders 210, 212 are then permitted to pivot upwardly to positions P5 due to the biasing forces of their respective members 211, 213, as shown in FIG. 13C.

Figures 13D, 13E:
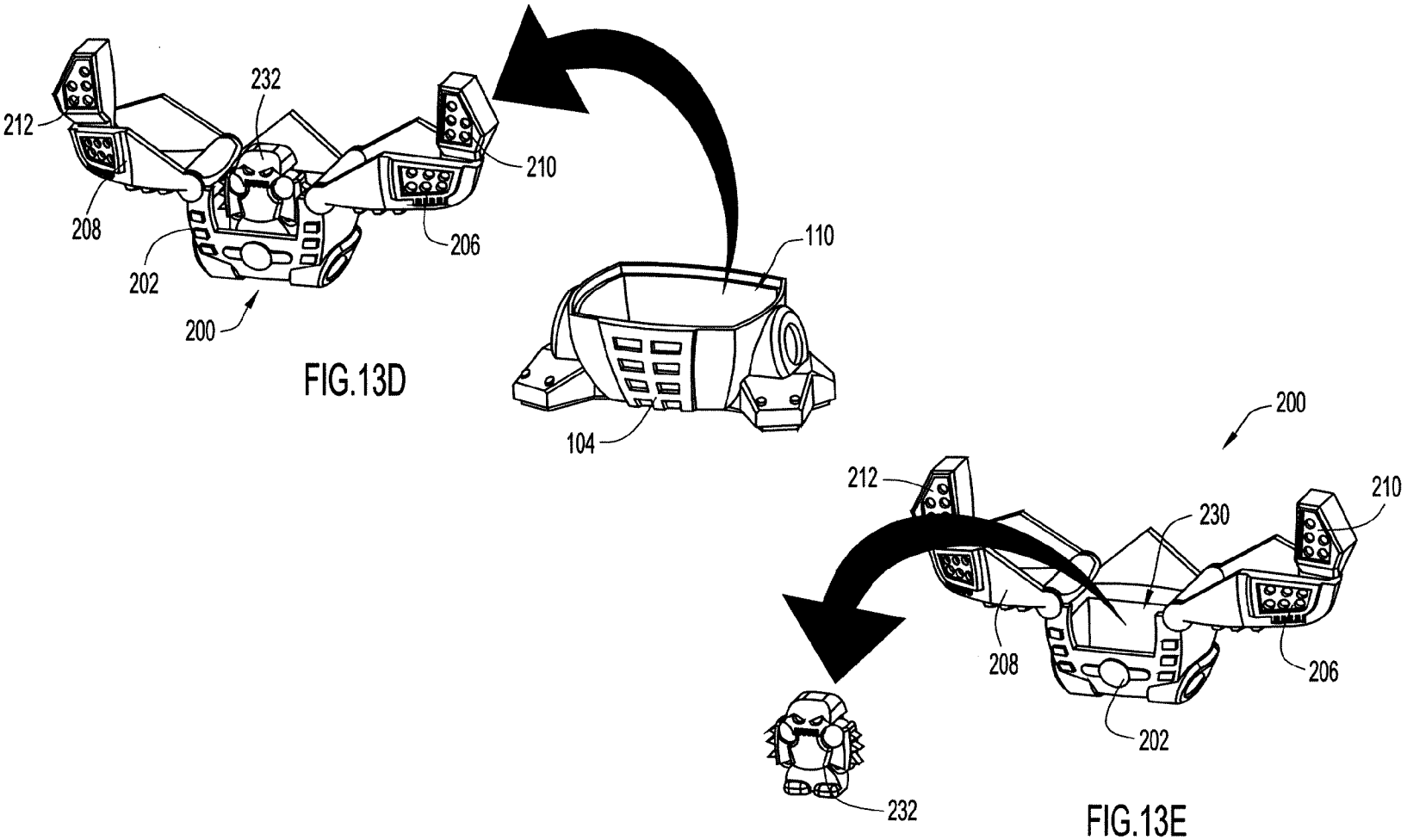
FIG. 13D illustrates a perspective view of the internal component in the deployed configuration and removed from the lower portion of the outer shell.
FIG. 13E illustrates a perspective view of the internal component and a secondary internal component removed from a cavity of the internal component.

Referring to FIGS. 13D and 13E, the internal component 200 may then be removed from the lower cavity 110 of the lower portion 104 of the outer shell 102. Further, the secondary internal component 232 may be removed from the cavity 230 of the main body 202 of the internal component 200. The arm members 206, 208 and extenders 210, 212 are in their expanded or deployed positions in FIGS. 13D and 13E.

Figure 14C:
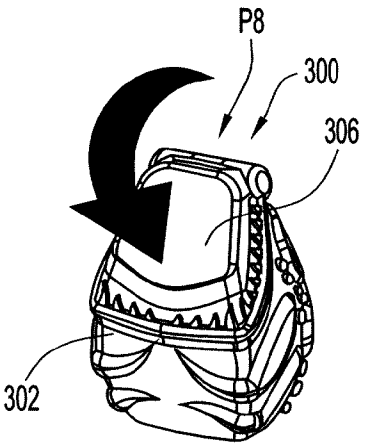
FIG. 14C illustrates a perspective view of the internal component of FIG. 14A, showing the lid member in a closed position.
Figure 14B:
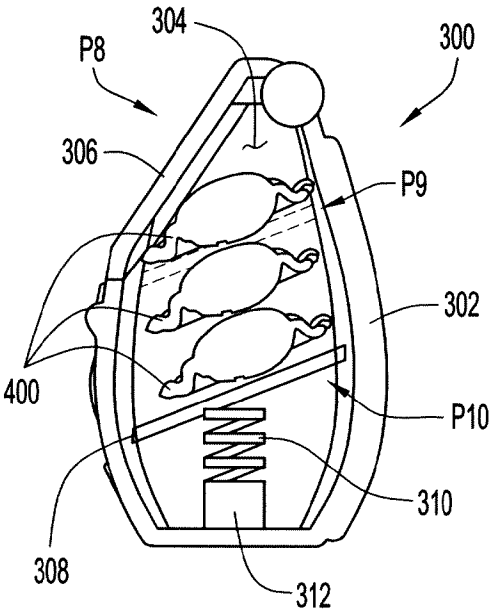
FIG. 14B illustrates a side sectional view of the internal component of FIG. 14A.
Figure 14A:
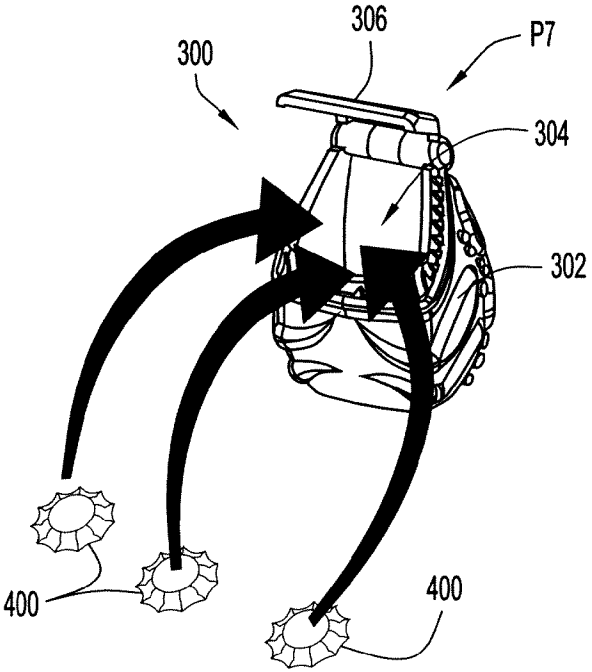
FIG. 14A illustrates a perspective view of an internal component according to another embodiment, showing a lid member of the internal component in an open position.

An internal component 300 according to another embodiment is illustrated in FIGS. 14A-14C. The internal component 300 includes a main body 302 defining a receptacle 304, and an extension or lid or cover member 306 movable between an open position P7 (shown in FIG. 14A) permitting access to the receptacle 304 and a closed position P8 (shown in FIGS. 14B and 14C) restricting access to the receptacle 304. A base member or plate 308 is disposed within the receptacle 304 and movable between a raised position P9 (shown in phantom in FIG. 14B) and a lowered position P10. The plate 308 is biased toward its raised position P9 via a resilient member, such as a spring 310. The plate 308 is retainable in its lowered position P10 via a catch 312 (shown schematically in FIG. 14B). Upon activation of the catch 312, the plate 308 is released from its lowered position P10 and rapidly moves toward its raised position P9 via the spring 310.

The receptacle 304 is configured to receive one or more projectiles 400 when the plate 308 is disposed in its lowered position P10, as shown in FIG. 14B. For example, three projectiles 400 may be received in the receptacle 304. The plate 308 may be pushed downwardly until releaseably locked in its lowered position P10 via the catch 312, with the projectiles 400 resting on the plate 308 and disposed within the receptacle 304.

As shown in FIG. 14C, the lid member 306 may then be moved to its closed position P8, thereby restricting access to the receptacle 304. In one implementation, the lid member 306 is hingedly connected to the main body 302 and moved toward its closed position P8 via gravity when the opening of the receptacle 304 is disposed upwardly (relative to a support surface). In another implementation, the lid member 306 is retained in its closed position P8 via a latch or clasp, which is simultaneously released and permits the lid member 306 to move to its open position P7 when the plate 308 is released from its lowered position P10. With the plate 308 disposed in its lowered position P10 and the projectiles 400 retained within the receptacle 304, the internal component 300 is "loaded" and ready for actuation.

Figure 15B:
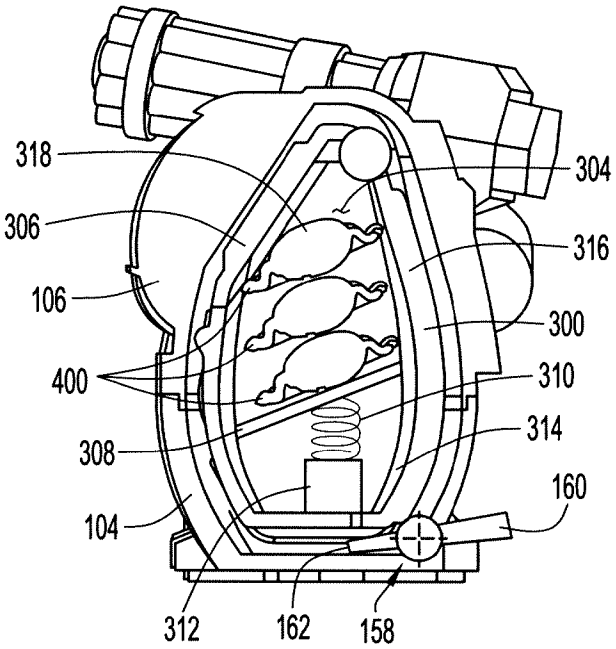
FIG. 15B illustrates a side sectional view of the outer shell and internal component of FIG. 15A.
Figure 15A:
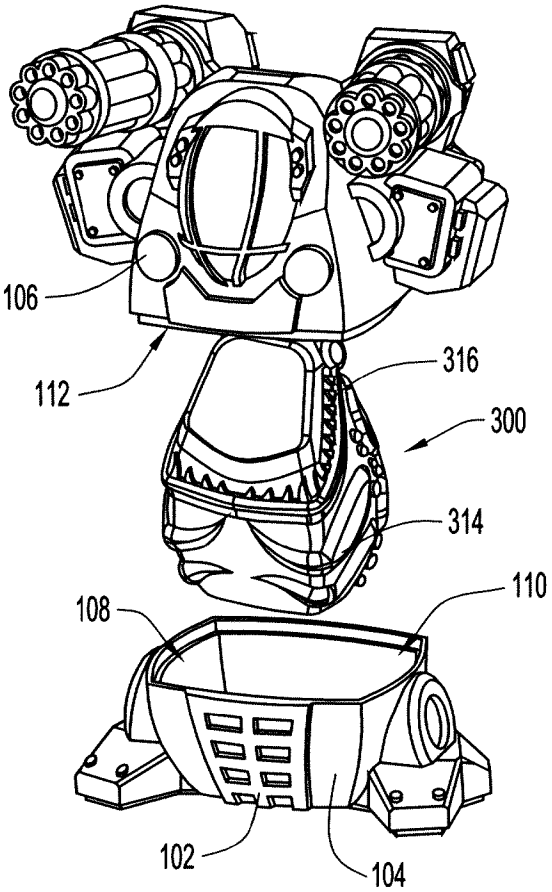
FIG. 15A illustrates a perspective view of the internal component of FIG. 14A being inserted into an outer shell.

Referring to FIGS. 15A and 15B, the internal component 300 is receivable in the receiving area 108 of the outer shell 102. A portion 314 of the internal component 300 is received in the lower cavity 110 of the lower portion 104, and another portion 316 of the internal component 300 is received in the upper cavity 112 of the upper portion 106. The internal component 300 is thus encased by the outer shell 102 when disposed within the receiving area 108, as shown in FIG. 15B.

With continued reference to FIG. 15B, the catch 312 of the internal component 300 is aligned with the inner member or portion 162 of the trigger or actuator 158, and may be actuated by depressing the outer member or portion 160 of the trigger 158 on the outer shell 102, as described above. Upon actuation of the catch 312, the plate 308 is no longer retained in its lowered position P10 via the catch 312. The plate 308 thus exerts an upward force on the projectiles 400. In turn, the projectiles 400 are forced against an inner surface 318 of the lid member 306 via the biasing force of the spring 310. However, the lid member 306 is retained in its closed position P8, and thus the projectiles 400 are retained under force within the receptacle 304 due to the space restrictions within the receiving area 108 of the outer shell 102. Thus, the internal component 300 is primed to forcibly move the lid 306 from its closed position P8 to its open position P7 and to forcibly eject the projectiles 400 from the receptacle 304 once the lid 306 is permitted to move to its open position P7.

Figure 15D:
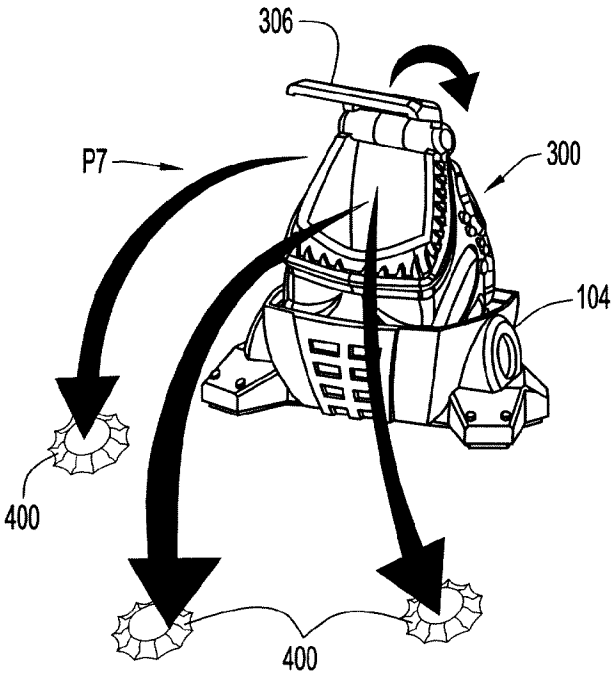
FIG. 15D illustrates a perspective view of the internal component and lower portion of the outer shell of FIG. 15C, showing projectiles being ejected from the internal component.
Figure 15C:
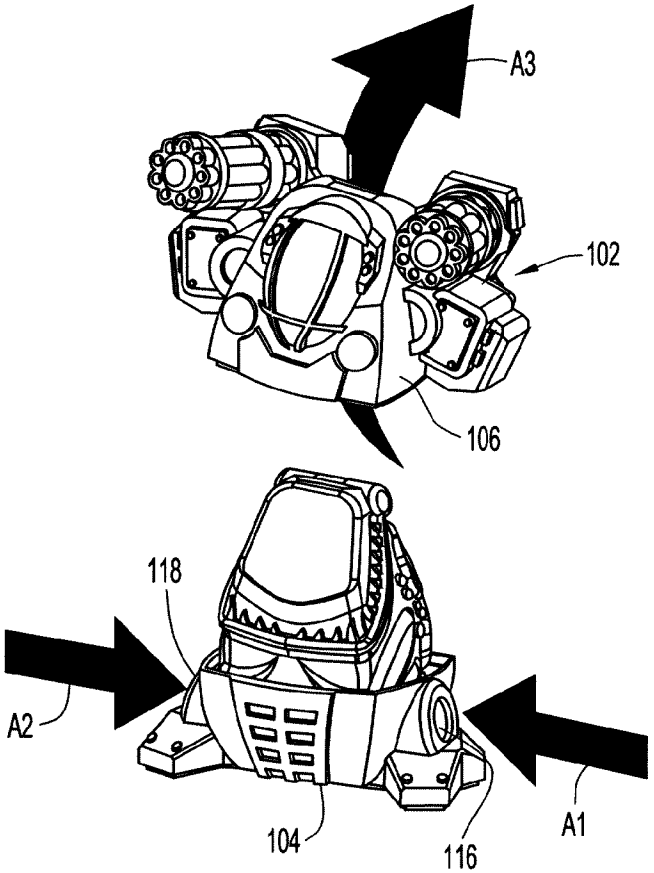
FIG. 15C illustrates a perspective view of the internal component of FIG. 15A disposed within the lower cavity of the lower portion of the outer shell, showing the upper portion of the outer shell being decoupled from the lower portion thereof.

Referring to FIGS. 15C and 15D, the upper portion 106 of the outer shell 102 may be ejected away from the lower portion 104 by activating the push buttons 116, 118, as described above. Once the upper portion 106 is decoupled from the lower portion 104, the lid member 306 is automatically forced to its open position P7, and the projectiles 400 are launched from the receptacle 304 and away from the internal component 300, as shown in FIG. 15D. The internal component 300 may then be removed from the lower cavity 110 of the lower portion 104 of the outer shell 102 and/or re-loaded with projectiles 400 (such as shown in FIG. 14A).

Figure 16:
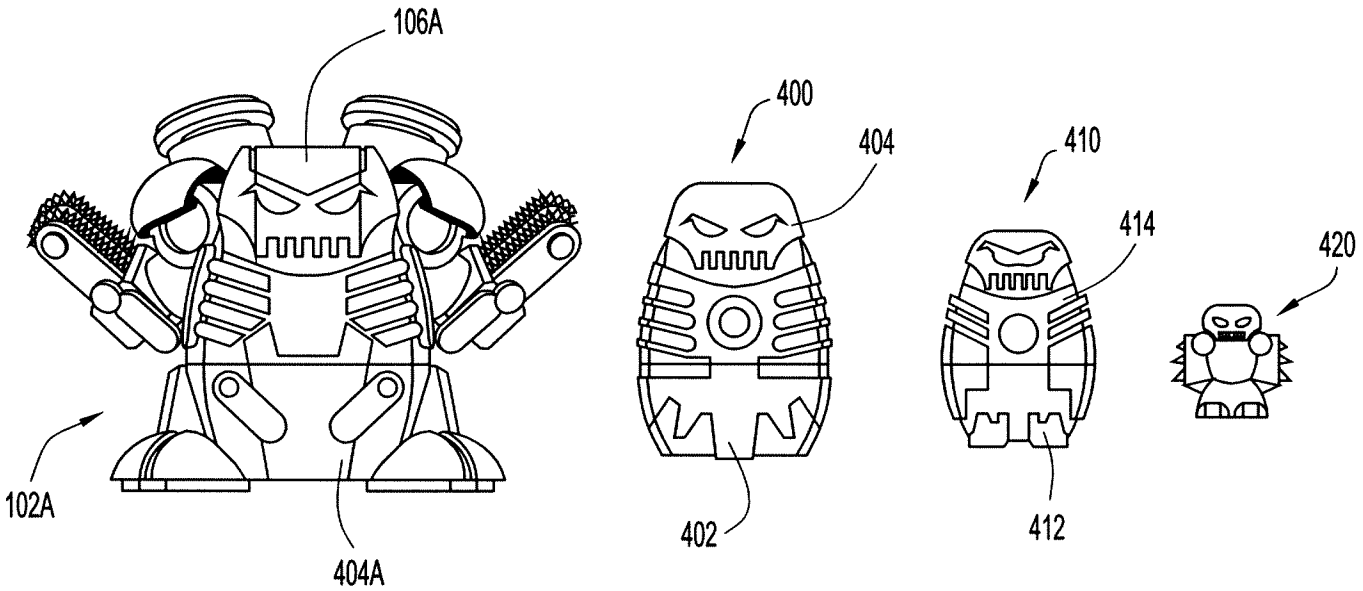
FIG. 16 illustrates a front perspective view of a nesting outer shell, internal components and a secondary internal component according to another embodiment of the present invention.

It should be understood that the specific configuration of the outer shell 102, the internal components 124, 200, 300 and/or the secondary internal components 154, 232 may vary. For example, an outer shell 102A according to another embodiment is illustrated in FIG. 16. Similar to the outer shell 102, the outer shell 102A includes a lower portion 104A releasably coupled to an upper portion 106A, as described above. The outer shell 102A includes a receiving area (such as described above) configured to receive any one of the internal components 124, 200, 300 and/or secondary internal components 154, 232 that were previously described.

Alternatively, an internal component having a configuration different from the internal components 124, 200, 300 may be received in the outer shell 102A (or 102). With continued reference to FIG. 16, several nesting internal components may be received within each other, and within the outer shell 102A (or 102). For example, an internal component 400 may be received within the outer shell 102A. The internal component 400 includes a lower portion 402 releasably coupleable to an upper portion 404. Another internal component 410 is received within a correspondingly configured cavity within the first internal component 400. The internal component 410 also includes a lower portion 412 releasably coupleable to an upper portion 414. A secondary internal component 420 is received within a correspondingly configured cavity defined by the lower and upper portions 412, 414 of the internal component 410.

Figure 17:
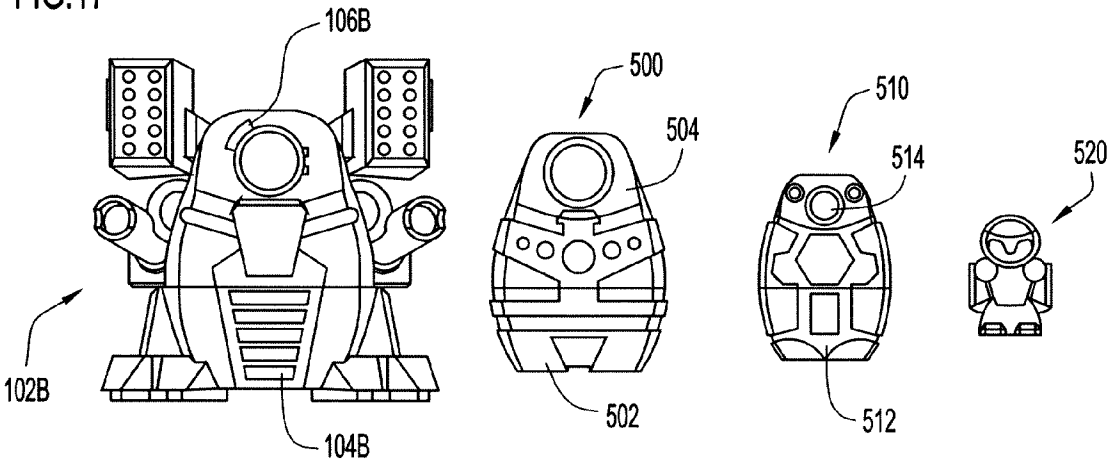
FIG. 17 illustrates a front perspective view of a nesting outer shell, internal components and a secondary internal component according to another embodiment of the present invention.

An outer shell 102B according to another embodiment is illustrated in FIG. 17. Similar to the outer shells 102, 102A, the outer shell 102B includes a lower portion 104B releasably coupled to an upper portion 106B, which together define an internal receiving area. An internal component 500 is received within the receiving area of the outer shell 102B. The internal component 500 includes a lower portion 502 releasably coupleable to an upper portion 504. Another internal component 510 is received within a correspondingly configured cavity within the first internal component 500. The internal component 510 also includes a lower portion 512 releasably coupleable to an upper portion 514. A secondary internal component 520 is received within a correspondingly configured cavity within the internal component 510.

Figure 18:
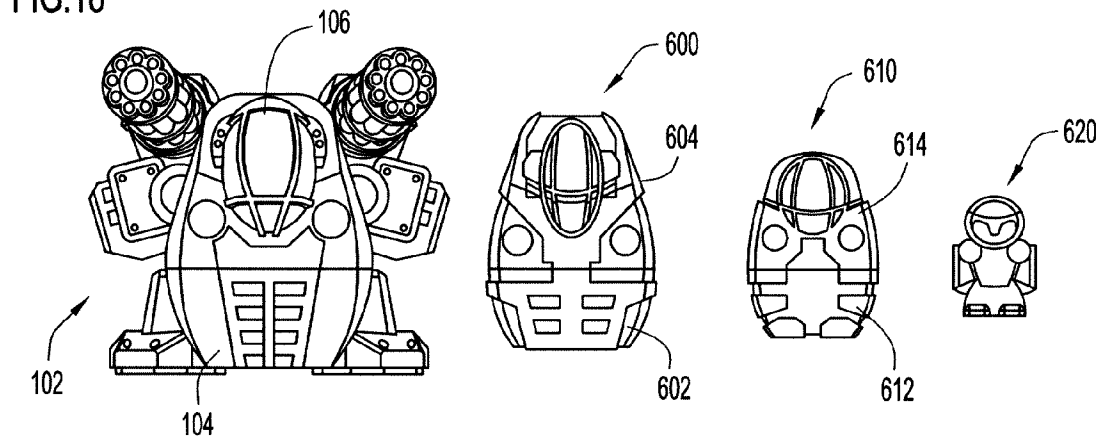
FIG. 18 illustrates a front perspective view of the outer shell of FIG. 4, and nesting internal components and a secondary internal component according to another embodiment of the present invention.
Figure 19:
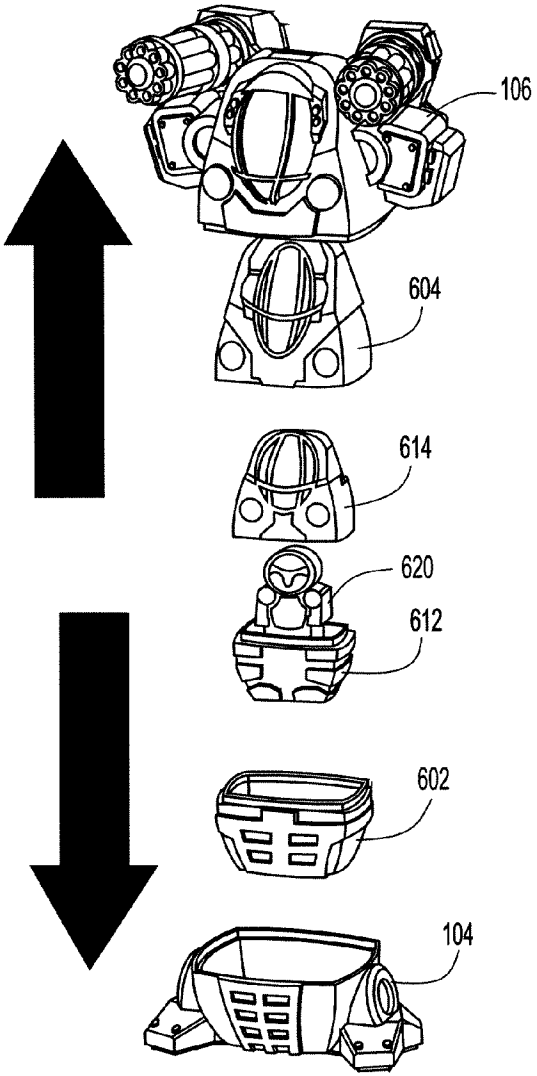
FIG. 19 illustrates an exploded assembly view of the outer shell, internal components and secondary internal component of FIG. 18.

Referring to FIGS. 18 and 19, several nesting components may also be received within the outer shell 102 described above. A first internal component 600 includes a lower portion 602 releasably coupleable to an upper portion 604, which together define a cavity. Another internal component 610 is received in the cavity of the first internal component 600. The internal component 610 also includes a lower portion 612 and an upper portion 614, which collectively define another cavity for receiving a secondary internal component 620.

In one embodiment, each of the outer shells 102, 102A, 102B is configured to receive any one of the internal components (e.g., 124, 200, 300, 400, 500, 600). In addition, another smaller internal component (e.g., 410, 510, 610) is receivable in a selected one of the internal components (e.g., 124, 200, 300, 400, 500, 600). Further, any one of the secondary internal components (e.g., 154, 232, 420, 520, 620) is receivable in the larger internal component. Thus, various play configurations are possible.

A child may create a unique toy assembly by selecting and assembling each of the outer shell, internal component(s) and secondary internal components. In one mode of play, a child may selectively create his or her toy assembly, and then challenge an opponent to a mock battle. The outer shell, internal component(s) and/or internal component of each toy assembly is assigned a specific value or point level. The child may then win the battle or challenge based on the point value of his or her outer shell character. Alternatively or in addition, each of the players may reveal their underlying internal components, which were unknown to the players prior to the dramatic separation of the upper and lower portions of the outer shell and/or the separation of the internal components (if nestable components were selected by the player when assembling his or her figure) and/or the reconfiguration of the internal components (if reconfigurable components were selected by the player when assembling his or her figure). Thus, revealing the internal components to an opposing player may result in a victory, a loss, a draw and/or further game requirements depending on the value assigned to each of the components (i.e., the outer shell, the internal components and/or the secondary internal components).

In an alternative embodiment, the transformation of an internal layer is activated when the top portion and the bottom portion of the outer layer are connected. As a result, in this embodiment, the characters are locked and loaded.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed is:

1. A reconfigurable toy assembly, comprising:

an external component including a first portion releasably coupled to a second portion, the first and second portions forming a cavity when coupled together;

a trigger coupled to the external component;

an internal component reconfigurable between a retracted configuration and a deployed configuration, the internal component being retained in the retracted configuration via a latch and released from the retracted configuration upon actuation of the latch, the internal component being receivable in the cavity in its retracted configuration; and at least one projectile coupled to the internal component, wherein the latch is actuatable by activating the trigger so that the internal component is primed to reconfigure from the retracted configuration to the deployed position upon decoupling of the first portion and the second portion, and the projectile is automatically launched from the internal component when the internal component moves from the retracted configuration to the deployed configuration.

2. The reconfigurable toy assembly of claim 1, wherein the internal component includes a body portion defining a cavity, and an extension member coupled to the body portion, and the extension member is movable between an open position permitting access to the cavity of the body portion and a closed position restricting access to the cavity of the body portion.

3. The reconfigurable toy assembly of claim 2, wherein the extension member is disposed in the open position when the internal component is in the deployed position, and the extension member is disposed in the closed position when the internal component is in the retracted position.

4. The reconfigurable toy assembly of claim 3, wherein at least one projectile is coupled to the internal component while the internal component is retained within the cavity of the external component.

5. The reconfigurable toy assembly of claim 2, further comprising:

a secondary internal component releasably disposable within the cavity of the internal component.

6. The reconfigurable toy assembly of claim 1, wherein the external component includes a lock mechanism configured to releasably secure the first portion to the second portion, and the lock mechanism includes a release actuatable by a user for decoupling the first portion to the second portion.

7. The reconfigurable toy assembly of claim 6, wherein the first portion is tensionably coupled to the second portion so that the first portion is forcibly ejected away from the second portion upon actuation of the release.

8. A reconfigurable toy assembly, comprising:

an external component including a first portion releasably coupled to a second portion, the first and second portions forming a cavity when coupled together;

a trigger coupled to the external component;

an internal component reconfigurable between a retracted configuration and a deployed configuration, the internal component including a latch thereon and being retained in the retracted configuration via the latch and released from the retracted configuration upon actuation of the latch, the internal component being receivable in the cavity in its retracted configuration, wherein the latch is actuatable by activating the trigger so that the trigger engages the latch while the internal component remains in the cavity of the external component while the first and second portions are coupled together.

9. The reconfigurable toy assembly of claim 8, further comprising:

at least one projectile coupled to the internal component, the projectile being automatically launched from the internal component when the internal component moves from the retracted configuration to the deployed configuration.

10. The reconfigurable toy assembly of claim 9, wherein the internal component includes a body portion defining a cavity, and an extension member coupled to the body portion, and the extension member is movable between an open position permitting access to the cavity of the body portion and a closed position restricting access to the cavity of the body portion.

11. The reconfigurable toy assembly of claim 10, wherein the extension member is disposed in the open position when the internal component is in the deployed position, and the extension member is disposed in the closed position when the internal component is in the retracted position.

12. The reconfigurable toy assembly of claim 11, wherein at least one projectile is coupled to the internal component while the internal component is retained within the cavity of the external component.

13. The reconfigurable toy assembly of claim 10, further comprising:

a secondary internal component releasably disposable within the cavity of the external component.

* * * * *